US005950575A

United States Patent [19]

Simons et al.

[11] Patent Number: 5,950,575

[45] Date of Patent: Sep. 14, 1999

[54] HYDRONIC MANIFOLD

[76] Inventors: David Simons, 17 Windsor Dr., Foxboro; Leslie G. Pelletz, 50 Mill St., Natick, both of Mass. 01760

[21] Appl. No.: 08/970,289

[22] Filed: Nov. 14, 1997

[51] Int. Cl.[6] ..... F22B 37/06; F15B 7/09

[52] U.S. Cl. ..... 122/511; 137/561 A; 237/56

[58] Field of Search ..... 122/367.1, 511; 137/197, 561 A; 237/56, 59

[56] References Cited

U.S. PATENT DOCUMENTS

| | | | |
|---|---|---|---|
| 2,722,942 | 11/1955 | Hencken | 137/197 |
| 4,564,142 | 1/1986 | Cleer, Jr. | 237/56 |
| 4,712,578 | 12/1987 | White | 137/561 A |
| 5,474,102 | 12/1995 | Lopez | 137/561 A |
| 5,707,007 | 1/1998 | Fiedrich | 237/56 |
| 5,778,765 | 7/1998 | Klawuhn et al. | 99/290 |

OTHER PUBLICATIONS

Product Information Sheet entitled "E–Z Headers" (See Part III of the Information Disclosure Statement).

*Primary Examiner*—Teresa Walberg
*Assistant Examiner*—Gregory A. Wilson
*Attorney, Agent, or Firm*—Wolf, Greenfield & Sacks, P.C.

[57] ABSTRACT

A manifold for distributing a circulating fluid, such as water, to multiple zones of a hydronic system, such as a hot water heating system. The manifold is of unitary construction and includes a plurality of distribution branches and an air scoop extending from a common header conduit. The air scoop extracts air from the water being circulated through the manifold. The air scoop may be coupled to an air vent to purge air from the water. The manifold may also include an expansion tank coupling that is disposed on the header conduit to couple the tank to the header conduit. The air scoop may include a housing affixed to the header conduit and a baffle that protrudes into the header conduit to direct air into the housing so that it can be vented through the air vent. The baffle may be angled relative to the longitudinal axis of the header conduit.

22 Claims, 3 Drawing Sheets

HYDRONIC MANIFOLD

BACKGROUND OF THE INVENTION

1. Field of the Invention

This invention relates to a manifold for hydronic systems and, more particularly, a manifold for hot water heating systems.

2. Discussion of the Related Art

A hydronic system involves the transfer of heat, for either heating or cooling applications, by a circulating fluid, such as water or vapor, in a closed system of pipes. A forced hot water heating system, which is a type of hydronic system commonly installed in residential houses, circulates water through a network of pipes to carry heat from a boiler to remotely located radiators which transfer heat to the surrounding air to heat the house.

Multiple zone heating systems, which comprise several individually controlled heating loops or circuits, are now routinely installed in residential houses. A multi-zone heating system allows the occupant of the house to maintain different temperatures in separate zones or areas of the house, such as particular rooms or separate floor levels, to reduce energy costs by selectively raising and lowering the temperature in the separate areas. A multi-zone heating system can also maintain a more uniform temperature throughout the house by providing heat to the cooler zones without also heating the warmer zones.

Although several benefits are derived from a multi-zone heating system, a significant amount of labor is involved in connecting the piping for the separate zones to the inlet and the outlet of the boiler. Since a conventional boiler includes a single inlet and a single outlet, the piping for each zone is typically coupled to the boiler in a complex arrangement of pipes and fittings that involves many joints that must be properly sealed to avoid system leaks. As the number of heating zones increases, so does the number of fittings and joints which increase the amount of labor and material costs and the chance of leaks associated with installing the system.

A hydronic manifold, as shown in FIG. 1, was developed by Applicants for use in multi-zone hot water heating systems to eliminate fittings and joints associated with conventional installations and thereby reduce installation costs and potential leaks. The manifold 10 is a welded construction and includes a plurality of branch conduits 12, extending from a header conduit 14, for coupling the separate heating zones of the system to the boiler. The manifold can be used as a supply header and a return header. While generally reducing the costs and the chance of leaks associated with the installation of heating systems, there is still a need for a further reduction in costs and leaks.

A hot water heating system also incorporates several separately installed components for proper system operation. For example, a separate air scoop and vent arrangement is installed on the supply or outlet side of the boiler to purge entrapped air from the water before it is circulated through the heating system. As heated water flows through the air scoop, suspended air bubbles are directed from the water stream to the air vent to be purged from the system. The heating system also includes an expansion tank to accommodate the thermal expansion of the heated water. The expansion tank is also typically coupled to the system piping on the supply side of the boiler using a separate fitting or a connection provided on the air scoop. Installation of these components also involves significant material and labor costs.

In view of the foregoing, it is an object of the present invention to provide an improved hydronic manifold for installing a heating system.

SUMMARY OF THE INVENTION

The present invention is a hydronic manifold for distributing a circulating fluid, such as water, to multiple zones of a hydronic system, such as a hot water heating system The manifold includes a plurality of distribution branches extending from a common header pipe and an air scoop, disposed on the header pipe, that may be coupled to an air vent to purge air from the circulating fluid. The manifold may also include an expansion tank coupling that is disposed on the header pipe. The manifold, which is of unitary construction, reduces the number of fittings and joints that may leak and reduces the amount of labor and material costs involved in connecting multiple heating zones to a boiler.

In one illustrative embodiment, the hydronic manifold comprises a header conduit having a flow passage that is adapted to carry fluid, a plurality of branch conduits affixed to a wall of the header conduit, and a scoop affixed to the wall of the header conduit. The wall has a plurality of distribution apertures and an extraction aperture extending therethrough. Each branch conduit is disposed at one of the distribution apertures so that at least a portion of the fluid can flow between the flow passage and the branch conduit through the distribution aperture. The scoop is disposed at the extraction aperture and is constructed and arranged to extract gas from the fluid in the flow passage through the extraction aperture.

In another illustrative embodiment, the hydronic manifold comprises a unitary header conduit that is constructed and arranged to be coupled to a boiler, a plurality of branch conduits laterally extending from the header conduit, and an integral scoop laterally extending from the header conduit. The header conduit has a flow passage that is adapted to carry the fluid. Each branch conduit is adapted to be fluidly coupled to one of a plurality of distribution conduits to distribute at least a portion of the fluid between the boiler and the distribution conduit. The scoop is constructed and arranged to extract gas from the fluid.

In a further illustrative embodiment, a heating system comprises a boiler that is constructed and arranged to heat water flowing therethrough, a plurality of pipes that are adapted to carry the water, and a manifold coupled between the boiler and the plurality of pipes. The manifold is a unitary construction and includes a header that is coupled to the boiler, a plurality of branch conduits affixed to the header and coupled to the plurality of pipes, and an air scoop affixed to the header. The header has a flow passage that is adapted to carry water therethrough. The air scoop is constructed and arranged to extract air from the water circulating through the flow passage.

BRIEF DESCRIPTION OF THE DRAWINGS

It should be understood that the drawings are provided for the purpose of illustration only and are not intended to define the limits of the invention. The foregoing and other objects and advantages of the present invention will become apparent with reference to the following detailed description when taken in conjunction with the accompanying drawings in which.

DETAILED DESCRIPTION OF AN ILLUSTRATIVE EMBODIMENT

Figure 1:
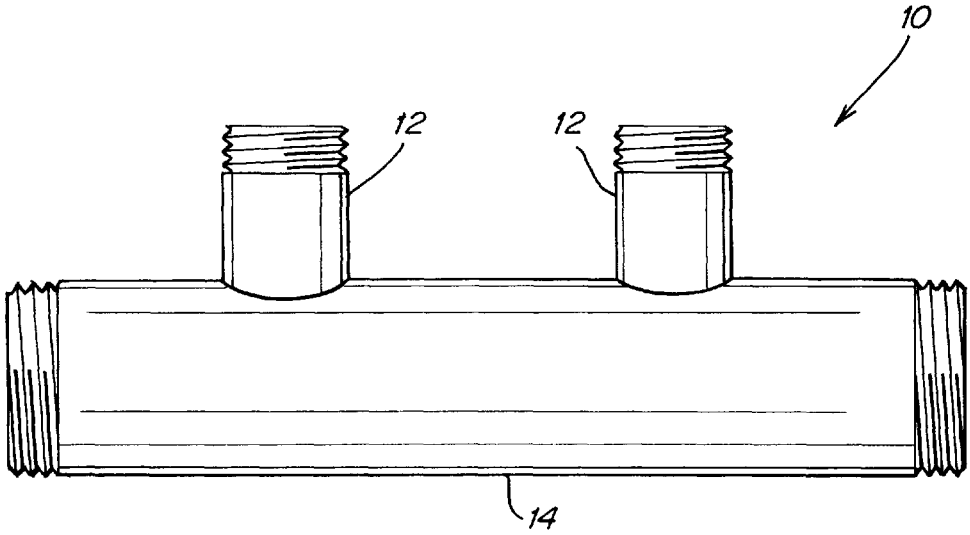
Fig. 1 PRIOR ART
FIG. 1 is a side view of a known hydronic manifold.
Figure 2:
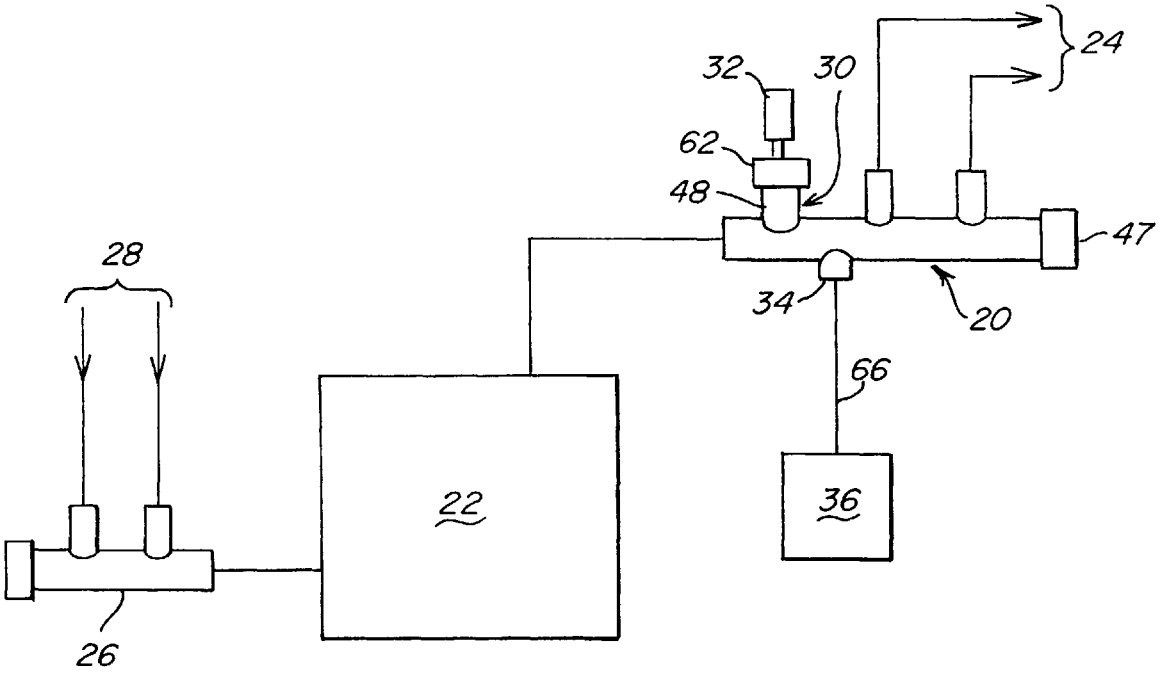
FIG. 2 is a schematic view of a heating system incorporating a hydronic manifold according to the present invention.

A hydronic supply manifold 20 for distributing heated fluid, such as water, to several heating zones may be fluidly coupled between a boiler 22, such as a conventional hot water boiler, and a plurality of supply pipes 24 as part of a multiple zone heating system as schematically illustrated in FIG. 2. A return manifold 26 for receiving cooled water from the heating zones may be similarly coupled between the boiler and a plurality of return pipes 28.

The supply manifold 20 includes an integral air scoop 30, as described below, that extracts entrapped air from the circulating water so that it can be purged from the system through a conventional air vent 32, such as a TACO 400 float type air vent, that is coupled to the air scoop. Additionally, the manifold 20 may include a coupling 34 for a conventional expansion tank 36, such as a Watts Manufacturing Model ET30 diaphragm heating expansion tank, that accommodates the thermal expansion of the water. Thus, the hydronic manifold 20 advantageously eliminates a separate air scoop, several fittings and corresponding joints, thereby reducing the costs and complexity associated with the installation of the heating system while increasing its reliability.

In one embodiment illustrated in FIGS. 3–6, the manifold 20 includes a header conduit 40, a pair of branch conduits 42 laterally extending from the header conduit 40, and an air scoop 30 for extracting entrapped air from water flowing through the manifold. The branch conduits 42 are fluidly coupled to the header conduit 40 through distribution apertures 43 (FIG. 4) in the wall of the header conduit. As heated water passes through the inlet 44 of the header conduit, it is distributed to separate heating zones through the branch conduits 42 which are coupled to corresponding supply pipes. In response to the heating demands of the particular zones, water may flow through one or more of the branch conduits 42 as controlled by system zone valves and circulating pumps (not shown).

In one embodiment, the air scoop 30 and the branch conduits 42 are aligned with each other along the length of the header conduit 40. This arrangement provides a clean and organized appearance that aligns piping for the the various zones of the heating system. It should be understood, however, that the manifold 20 may be configured with the air scoop 30 and the branch conduits 42 arranged in any suitable manner as would be apparent to one of skill in the art to accommodate a particular heating system configuration.

As illustrated, the manifold 20 is configured for a two-zone system, wherein each branch conduit 42 is to be coupled to one of the heating zones. To accommodate future expansion, the end 46 of the header conduit opposite the inlet 44 is adapted to be coupled with piping to provide an additional heating zone. In one embodiment as shown in FIG. 2, the expansion end 46 of the header conduit 40 may be sealed with a cap 47, such as a conventional pipe cap, which can be removed should system zone expansion result in the number of heating zones exceeding the number of available branch conduits 42. It is to be understood that the manifold may be configured with any number of branch conduits 42 to accommodate heating systems having a larger number of zones. Any unused branch conduits 42 may also be sealed with a removable cap for future expansion.

The manifold 20 is provided with an integral air scoop 30 for extracting entrapped air from the circulating water. In an illustrative embodiment as shown in FIGS. 3–6, the air scoop 30 includes a housing 48 that laterally extends from the header conduit 40, and a baffle 50 that protrudes into the flow passage 52 of the header conduit 40 below the housing 48. The air scoop 30 is positioned toward the inlet 44 of the header conduit 40 to extract entrapped air from the circulating water before it is distributed to the various zones of the heating system through the branch conduits 42. The incorporation of the air scoop 30 in the manifold 20 advantageously replaces the conventional air scoop routinely installed in hot water heating systems.

The baffle 50 is disposed at an angle A (FIG. 6) relative to the longitudinal axis of the flow passage 52 to direct entrapped air through an extraction aperture 53 in the header wall and into a chamber 54 in the housing 48. The baffle extends into the flow passage 52 away from the inner wall 56 of the header conduit so that the water can freely flow across the upper and lower surfaces of the baffle to avoid creating a flow restriction in the header conduit.

As illustrated, the baffle 50 is comprised of a U-shaped curved member having its opposite ends 58 (FIG. 4) affixed to the wall of the header conduit 40 at the extraction aperture 53. In one embodiment, the baffle has a radius R (FIG. 6) of approximately ⅝" and it is positioned at an angle A of approximately 45° relative to the axis of the header conduit. The leading edge 60 of the baffle 50 protrudes into the flow passage 52 approximately 9/32" at the central vertical plane 61 (FIG. 5) of the header conduit. It should be understood, however, that the baffle 50 may be configured and positioned in any suitable manner apparent to one of skill for extracting entrapped air from the circulated water.

The air vent 32 may be connected to the air scoop housing 48 with a removable cap 62 (FIG. 2) that is adapted to fluidly couple the chamber 54 to the air vent 32. In one embodiment, the cap 62 is tapped to connect the air vent 32 to the manifold.

Figure 3:
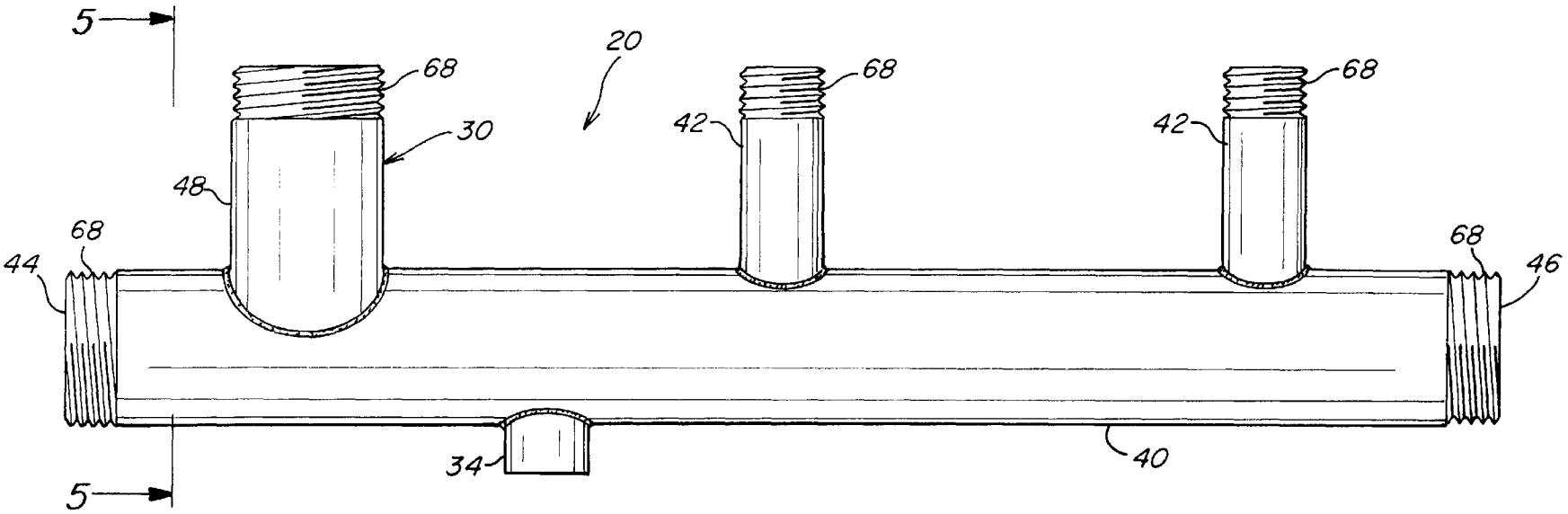
FIG. 3 is a side view of the hydronic manifold according to the present invention.
Figure 4:
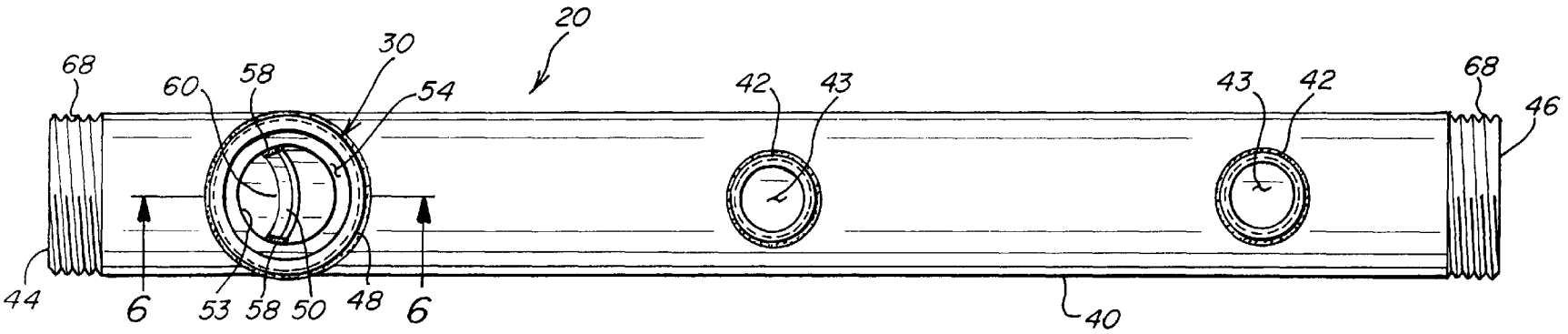
FIG. 4 is a top view of the hydronic manifold of FIG. 3.
Figure 5:
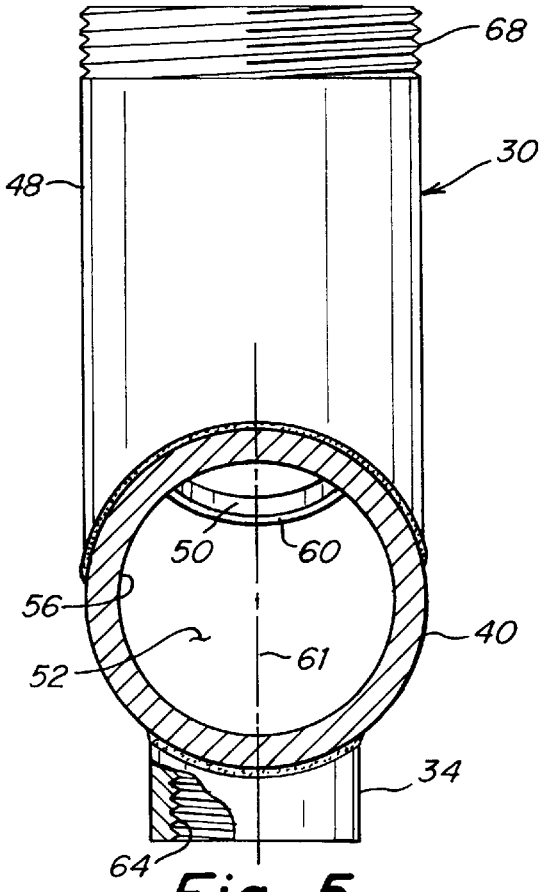
FIG. 5 is a cross-sectional view taken along section line 5—5 in FIG. 3.
Figure 6:
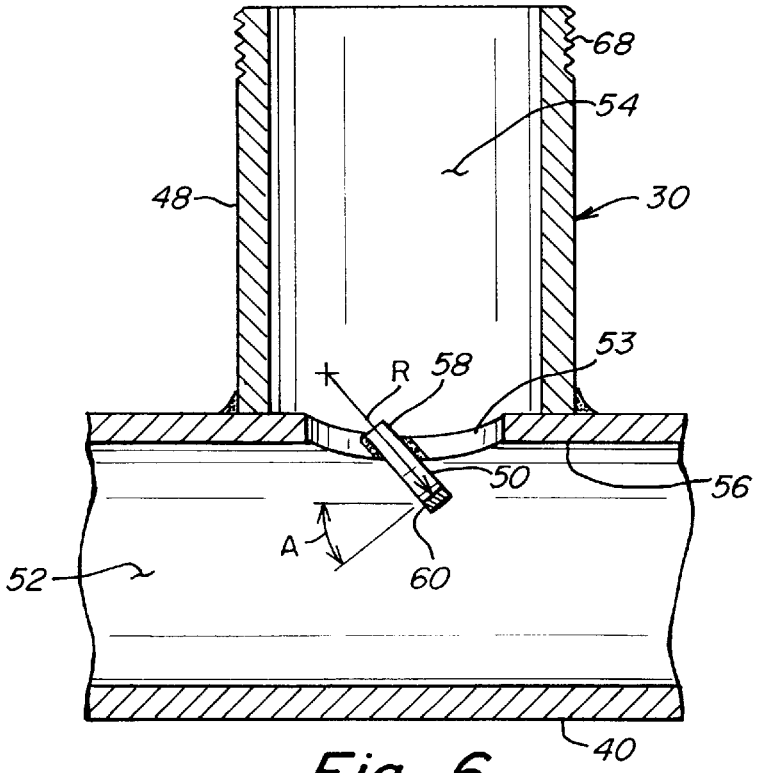
FIG. 6 is a cross-sectional view of the air scoop taken along section line 6—6 in FIG. 4.

As shown in FIGS. 2, 3 and 5, the manifold 20 includes an integral coupling 34 for fluidly coupling the manifold to the expansion tank 36 of the heating system. In one embodiment, the coupling includes internal threads 64 (FIG. 5) that are adapted to mate with corresponding threads on the piping 66 (FIG. 2) connecting the expansion tank to the manifold. The coupling 34 may be configured to connect the expansion tank to the manifold in any other suitable manner, such as with a solder joint.

As illustrated, the coupling 34 laterally extends from the side of the header conduit 40 opposite the air scoop 30 and branch conduits 42. The coupling 34 is also positioned between the air scoop 34 and the adjacent branch conduit 42 The coupling 34, however, may be positioned at any suitable location along the header conduit 40 as would be apparent to one of skill in the art.

In one embodiment, the manifold 20 is a welded construction of metal pipe, such as suitable steel or copper pipe. The ends of the header conduit 40 and the branch conduits 42 include external threads 68 that provide convenient means for coupling the manifold to the heating system. It is to be appreciated that the header conduit and branch conduits may be configured to be soldered into the heating system. The header conduit 40 and the air scoop housing 48 each are formed of 1¼" pipe, and the branch conduits 42 are formed of ¾" to 1" pipe. The header conduit 40 has a length of approximately 18" with the branch conduits 42 and the scoop housing 48 laterally extending from the header conduit approximately 2¾". The air scoop 30 and the branch conduit 42 adjacent the expansion end 42 are spaced approximately 3" from the respective ends of the header conduit. The air scoop and adjacent branch conduits are spaced approximately 6" on center to advantageously allow the installation, if desired, of a conventional circulation pump on each branch conduit. It should be understood, however, that the manifold 20 may be configured in various sizes and formed as a unitary structure from any suitable material using other methods, such as casting.

Although described in conjunction with a hot water heating system, the hydronic manifold 20 may be used for other multi-zone applications that would benefit from the extraction of a gas from a circulating fluid. The manifold 20 may also be used in a heating or other system as a return manifold by locating the air scoop 30 toward the end of the header conduit that is coupled to the boiler and reversing the direction of the baffle to face into the oncoming fluid.

Having described an embodiment of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only by the following claims and their equivalents.

What is claimed is:

1. A hydronic manifold comprising:

a header conduit having a flow passage adapted to carry fluid and including a wall having a plurality of distribution apertures and an extraction aperture extending therethrough;

a plurality of branch conduits affixed to the wall of the header conduit, each branch conduit being disposed at one of the distribution apertures so that at least a portion of the fluid can flow between the flow passage and the branch conduit through the distribution aperture; and a scoop affixed to the wall of the header conduit at the extraction aperture, the scoop being constructed and arranged to extract gas from the fluid in the flow passage through the extraction aperture, wherein the scoop includes a baffle that is disposed adjacent the extraction aperture.

2. The hydronic manifold recited in claim 1, wherein the baffle protrudes into the flow passage.

3. The hydronic manifold recited in claim 2, wherein the baffle is angled relative to the longitudinal axis of the flow passage.

4. The hydronic manifold recited in claim 2, wherein the baffle includes an arcuate member.

5. The hydronic manifold recited in claim 1, wherein the baffle includes opposite ends that are affixed to the wall of the header conduit.

6. The hydronic manifold recited in claim 1, wherein the scoop further includes a housing having a chamber that is adapted to receive gas extracted from the fluid.

7. The hydronic manifold recited in claim 6, wherein the housing is constructed and arranged to be fluidly coupled to a vent that is adapted to purge the gas extracted from the fluid.

8. The hydronic manifold recited in claim 1, further comprising a coupling affixed to the wall of the header conduit, the coupling being adapted to couple an expansion tank to the flow passage.

9. A hydronic manifold for distributing fluid between a boiler and a plurality of distribution conduits, the hydronic manifold comprising:

a unitary header conduit that is constructed and arranged to be coupled to the boiler, the header conduit having a flow passage that is adapted to carry the fluid;

a plurality of branch conduits laterally extending from the header conduit, each branch conduit adapted to be fluidly coupled to one of the distribution conduits to distribute at least a portion of the fluid between the boiler and the distribution conduit; and an integral scoop laterally extending from the header conduit, the scoop being constructed and arranged to extract gas from the fluid, wherein the scoop includes a baffle that protrudes into the flow passage.

10. The hydronic manifold recited in claim 9, wherein the baffle is angled relative to the longitudinal axis of the flow passage.

11. The hydronic manifold recited in claim 9, wherein the baffle includes an arcuate member.

12. The hydronic manifold recited in claim 11, wherein the baffle is U-shaped and includes opposite ends that are connected to the header conduit.

13. The hydronic manifold recited in claim 9, wherein the scoop further includes a housing having a chamber that is adapted to receive gas extracted from the fluid.

14. The hydronic manifold recited in claim 13, wherein the housing is constructed and arranged to be fluidly coupled to a vent that is adapted to purge the gas extracted from the fluid.

15. The hydronic manifold recited in claim 9, further comprising a coupling affixed to the header conduit, the coupling being adapted to couple an expansion tank to the flow passage.

16. A heating system comprising:

a boiler that is constructed and arranged to heat water flowing therethrough;

a plurality of pipes that are adapted to carry the water; and a manifold coupled between the boiler and the plurality of pipes, the manifold being a unitary construction and including:

a header conduit that is coupled to the boiler, the header conduit having a flow passage that is adapted to carry water therethrough;

a plurality of branch conduits affixed to the header conduit and coupled to the plurality of pipes; and an air scoop affixed to the header conduit and being constructed and arranged to extract air from the water circulating through the flow passage, wherein the air scoop includes a baffle that protrudes into the flow passage.

17. The heating system recited in claim 16, wherein the baffle is angled relative to the longitudinal axis of the flow passage.

18. The heating system recited in claim 16, wherein the baffle includes an arcuate member.

19. The heating system recited in claim 18, wherein the baffle is U-shaped and includes opposite ends that are connected to the header conduit.

20. The heating system recited in claim 16, wherein the air scoop further includes a housing having a chamber that is adapted to receive air extracted from the water.

21. The heating system recited in claim 20, further comprising an air vent fluidly coupled to the chamber, the air vent being adapted to vent the air from the air scoop.

22. The heating system recited in claim 16, further comprising an expansion tank, the manifold including a coupling affixed to the header conduit, the expansion tank being connected to the manifold at the coupling to fluidly couple the expansion tank to the flow passage.

* * * * *